US009367034B2

(12) United States Patent
Yoshino

(10) Patent No.: US 9,367,034 B2
(45) Date of Patent: Jun. 14, 2016

(54) IMAGE FORMING APPARATUS

(71) Applicant: CANON KABUSHIKI KAISHA, Tokyo (JP)

(72) Inventor: Daiju Yoshino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/198,864

(22) Filed: Mar. 6, 2014

(65) Prior Publication Data

US 2014/0255057 A1 Sep. 11, 2014

(30) Foreign Application Priority Data

Mar. 8, 2013 (JP) ..... 2013-046724

(51) Int. Cl.
*G03G 21/20* (2006.01)

(52) U.S. Cl.
CPC ..... *G03G 21/206* (2013.01)

(58) Field of Classification Search
None
See application file for complete search history.

(56) References Cited

FOREIGN PATENT DOCUMENTS

| | | | | | |
|---|---|---|---|---|---|
| JP | 06-008581 | A | | 1/1994 | |
| JP | 07-271272 | A | | 10/1995 | |
| JP | 2007-079125 | A | * | 9/2005 | ..... G10K 11/16 |
| JP | 2007-079125 | A | | 3/2007 | |
| JP | 2008-083301 | A | | 4/2008 | |
| JP | 2013-024952 | A | | 2/2013 | |

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes a suction port, provided in a front side of a main assembly of the image forming apparatus, for sucking air; an air flow guiding portion for guiding the air sucked through the suction port; and a sound source, provided in a rear side of the main assembly so as to oppose a space connected with the air flow guiding portion, for generating a sound used to notify an operator.

27 Claims, 6 Drawing Sheets

IMAGE FORMING APPARATUS

FIELD OF THE INVENTION AND RELATED ART

The present invention relates to an air suction and exhaust device for sucking air into a casing and for exhausting the air from the casing, and relates to an image forming apparatus, including the air suction and exhaust device, such as a copying machine, a printer, a facsimile machine or a multi-function machine of these machines.

Inside the casing constituting the image forming apparatus, electric substrates for mounting electronic components such as a resistor, a capacitor and a control element, and motors for operating various devices and the like are provided. Further, in the case of an image forming apparatus of an electrophotographic type, a fixing device for heat-fixing a toner image on a recording material is also provided. These members generate heat depending on operations thereof to dissipate the heat to peripheral members, so that a temperature at the inside of the casing is increased to influence on the operations of the devices in some cases. For this reason, a structure in which a fan motor and a duct are provided inside the casing to create a flow of air inside the casing, and thus a temperature rise is suppressed has been conventionally known (e.g., Japanese Laid-Open Patent Application (JP-A) 2008-83301 and JP-A Hei 7-271272).

On the other hand, in some cases, the image forming apparatus is provided with a speaker (sound generating means) for notifying a user of information, such as an end of an operation. Such a speaker is, in order to facilitate listening of the sound by the user, ordinarily disposed in a side, where the image forming apparatus is operated, e.g., at a front surface of the image forming apparatus (e.g., JP-A 2013-24952).

Here, for example, in the case of the image forming apparatus such as the facsimile machine, a device for carrying out communication is provided in a rear side of the image forming apparatus, i.e., at a position remote from the side where the image forming apparatus is operated. For this reason, in order to generate information, sent from the communication device, from the speaker, there is a need to connect the device, provided in the rear side of the image forming apparatus, with the speaker provided in the front side by wiring. Inside the image forming apparatus, various devices are incorporated, and the connection of the devices which are positioned at remote positions with the speaker is troublesome and involves a cumbersome operation, so that a manufacturing cost is increased. On the other hand, in the case where the speaker is simply disposed together with the devices in the rear side of the image forming apparatus, the sound from the speaker is not readily heard by the user.

SUMMARY OF THE INVENTION

The present invention has been accomplished in view of the above-described circumstances. A principal object of a present invention to provide an image forming apparatus capable of inexpensively realizing a structure capable of facilitating listening (hearing) of a sound even when a sound generating device is provided at a position remote from a side where the image forming apparatus is operated.

According to an aspect of the present invention, there is provided an image forming apparatus comprising: a suction port, provided in a front side of a main assembly of the image forming apparatus, for sucking air; an air flow guiding portion for guiding the air sucked through the suction port; and a sound source, provided in a rear side of the main assembly so as to oppose a space connected with the air flow guiding portion, for generating a sound used to notify an operator.

These and other objects, features and advantages of the present invention will become more apparent upon a consideration of the following description of the preferred embodiments of the present invention taken in conjunction with the accompanying drawings.

DESCRIPTION OF THE EMBODIMENTS

An embodiment of the present invention will be described with reference to FIGS. 1 to 6. First, a general structure of an image forming apparatus according to this embodiment will be described with reference to FIGS. 1 and 2.

[Image Forming Apparatus]

Figure 1:
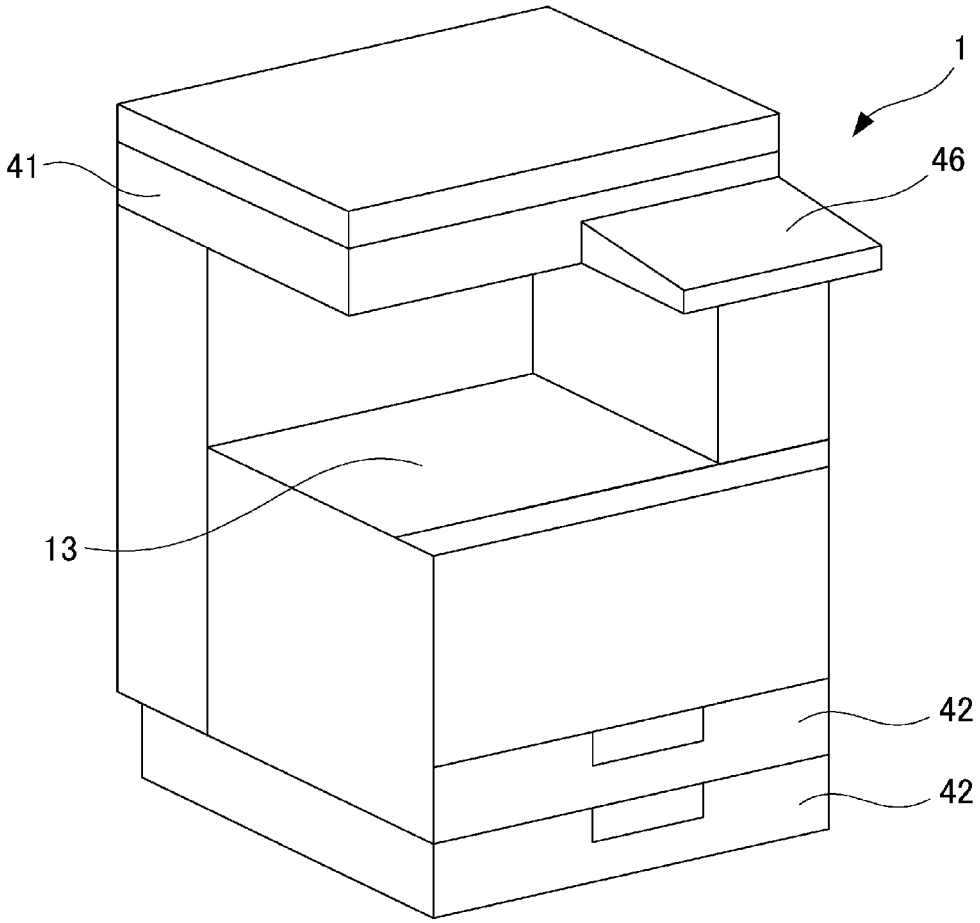
FIG. 1 is a schematic perspective view of an image forming apparatus provided with an air suction and exhaust device in an embodiment of the present invention.
Figure 2:
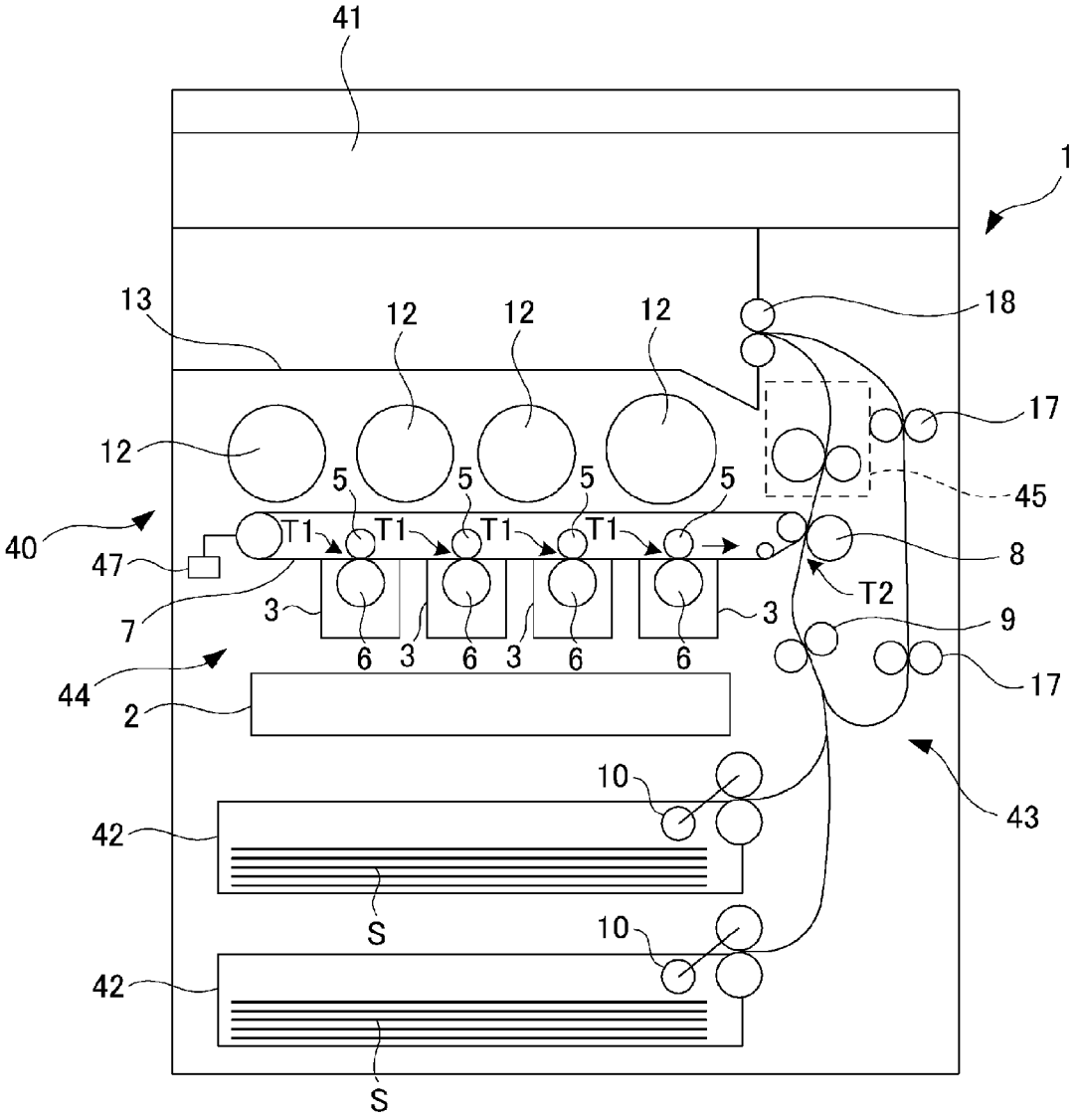
FIG. 2 is a schematic sectional view of the image forming apparatus in the embodiment.
Figure 3:
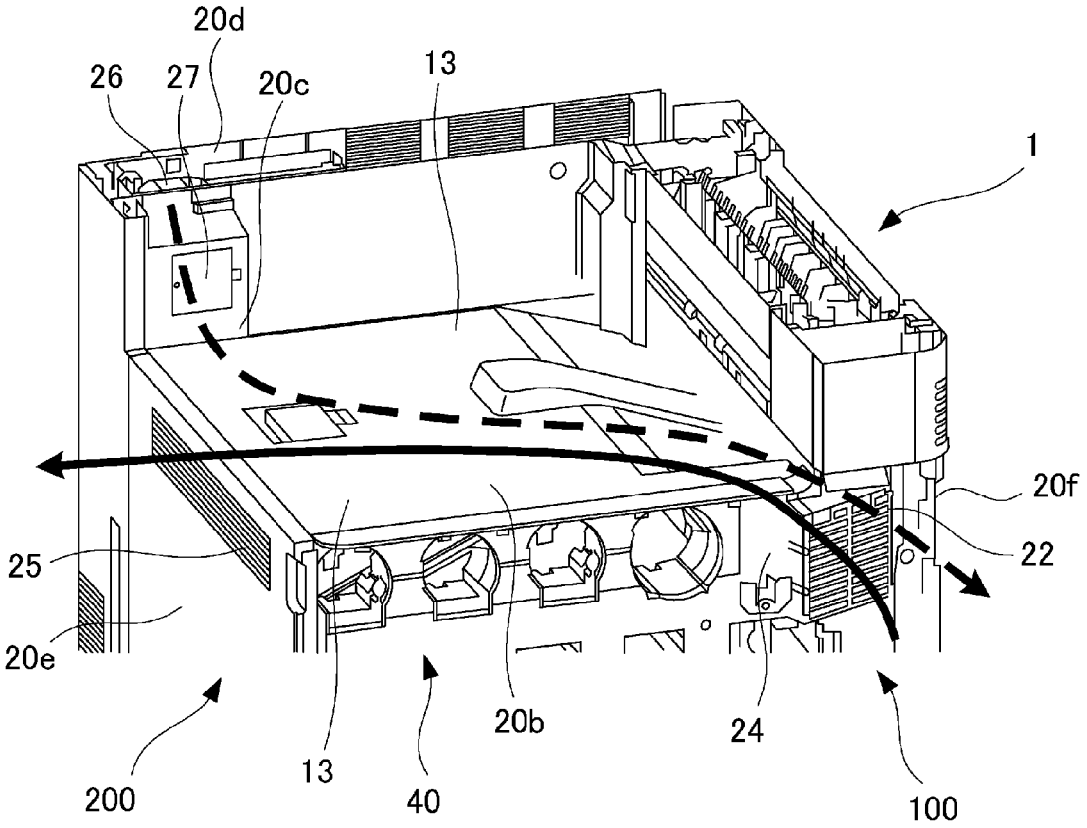
FIG. 3 is a perspective view partly showing the image forming apparatus by cutting away a part of the image forming apparatus in the embodiment.
Figure 4:
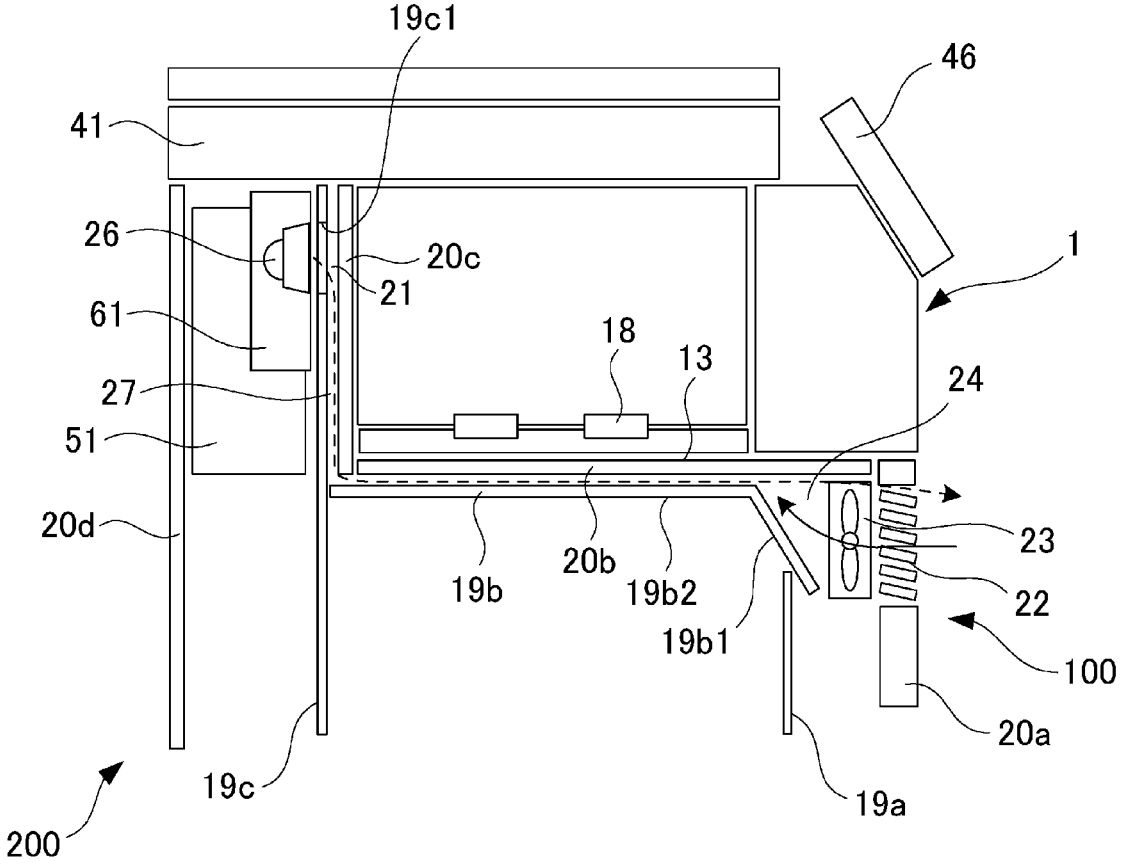
FIG. 4 is a schematic sectional view showing the image forming apparatus by omitting a part of the image forming apparatus in the embodiment.

An image forming apparatus 1 is of a so-called tandem type in which four photosensitive drums 6 as image bearing members for bearing toner images of colors of yellow (Y), magenta (M), cyan (C) and black (K) are arranged in a traveling (movement) direction of an intermediary transfer belt 7 as an intermediary transfer member. Such an image forming apparatus 1 includes an image forming portion 40 as an image forming means, a scanner 41 as an original reading portion, a cassette 42 as a recording material supporting portion, a recording material feeding portion 43 as a feeding means, an operating portion 46 and an air suction and exhaust device 100 (FIGS. 3 and 4). The scanner 41 reads information of an original placed on a platen glass or the information of the original fed from an original feeding device thereof to the platen glass.

The image forming portion 40 includes an image forming unit 44 and a fixing device 45. The image forming unit 44 includes process cartridges 3 for the respective colors, an exposure unit 2 for irradiating the respective photosensitive drums 6 with laser light, the intermediary transfer belt 7, primary transfer rollers 5 as a primary transfer means, a secondary transfer roller 8 as a secondary transfer means, and the like. Each of the process cartridges 3 includes the photosensitive drum 6, an unshown charger, a developing device and a cleaner which are provided at a periphery of the photosensitive drum 6.

The intermediary transfer belt 7 is stretched by a plurality of stretching rollers and is provided adjacently to the respective process cartridges, thus contacting the respective photosensitive drums 6. Such an intermediary transfer belt 7 is moved in an arrow direction in FIG. 2 by rotationally driving any one (driving roller) of the plurality of stretching rollers connected with an unshown motor. At positions opposing the respective photosensitive drums 6 via the intermediary transfer belt 7, the primary transfer rollers 5 are disposed, respectively. Further, with respect to a movement (traveling) direction of the intermediary transfer belt 7, the secondary transfer roller 8 is disposed, downstream of the process cartridges 3, in contact with the intermediary transfer belt 7 to form a secondary transfer portion T2 between the secondary transfer roller 8 and the intermediary transfer belt 7.

Incidentally, the intermediary transfer belt 7 and the primary transfer rollers 5 opposing the photosensitive drums 6 for Y, M and C are constituted so as to enable a contact and separation operation of the photosensitive drums 6 by a contact and separation mechanism (spacing mechanism) 47. The contact and separation mechanism 47 is constituted by, e.g., a frame, a supporting portion and a driving mechanism. The frame supports one of the stretching rollers for the intermediary transfer belt 7 and the primary transfer rollers 5 opposing the photosensitive drums 6 for Y, M and C. The supporting portion swingably supports this frame. The driving mechanism swings this frame about the supporting portion and is, e.g., a cam mechanism. By controlling the driving mechanism by a controller 51 described later, the frame is swung, so that the intermediary transfer belt 7 and the primary transfer rollers opposing the photosensitive drums 6 for Y, M and C are contacted to and separated (spaced) from the photosensitive drums 6. The primary transfer roller 5 opposing the photosensitive drum 6 for K is not moved irrespective of the operation of the contact and separation mechanism 47, and sandwiches the intermediary transfer belt 7 between the primary transfer roller 5 and the photosensitive drum 6. As a result, the image forming apparatus 1 is capable of executing operations in a full-color mode and a monochromatic mode.

The exposure unit 2 is disposed in an opposite side from the intermediary transfer belt 7 via the process cartridges 3, and irradiates the photosensitive drums 6 with the laser light on the basis of information read by the scanner 41 or information sent from an external device. Further, in the case of this embodiment, the developing devices of the process cartridges 3 include toner containers (bottles) 12 for supplying toners for the respective colors. The fixing device 45 is disposed downstream of the secondary transfer portion T2 with respect to a recording material feeding direction of the recording material feeding portion 43, and heats and presses the recording material, on which the toner image is carried, to fix the toner image on the recording material.

The cassette 42 accommodates a recording material S such as paper or a sheet. In this embodiment, there are a plurality of cassettes 42 which include the recording materials of the same type. Further, as described later, in the case where the recording material in one of the cassettes 42 is used up, the cassette 42 is switched to another cassette 42, so that the recording material can be supplied to the recording material feeding portion 43. Incidentally, the plurality of cassettes 42 may also accommodate recording materials of different types (e.g., having different sizes). Then, by switching the cassette 42, the recording material can also be supplied to the recording material feeding portion 43 depending on an image forming condition (such as a size of the recording material).

The recording material feeding portion 43 picks up the recording material from the cassette 42 and then feeds the recording material to the fixing device 45 via the secondary transfer portion T2 to discharge the recording material, after fixing, onto a discharge tray 13. Further, the recording material feeding portion 43 also includes a reverse feeding mechanism for inverting and feeding the recording material in order to effect double-side printing.

The operating portion 46 is disposed in a side where devices of the image forming apparatus 1 are operated, and at the operating portion 46, a user makes various settings. The operating portion 46 is constituted by, e.g., a touch panel and operating buttons, and the user operates these members to effect the various settings, such as setting of the number of sheets subjected to image formation.

An image forming process of the thus-constituted image forming apparatus 1 is as follows. First, the surface of each of the photosensitive drums 6 for the respective colors is electrically charged by the charger and then is exposed to light by the exposure unit 2 to form a latent image on the photosensitive drum 6. The latent image is developed by the developing device, so that a toner image is formed on the photosensitive drum 6. The toner image formed on the photosensitive drum 6 reaches a primary transfer portion T1 where the photosensitive drum 6 and the intermediary transfer belt are in contact with each other. Then, at the respective primary transfer portions T1, a primary transfer bias is applied to each of the primary transfer rollers 5, so that the toner images on the photosensitive drums 6 are successively transferred onto the intermediary transfer belt 7, and thus a full-color toner image is formed on the intermediary transfer belt 7. This toner image is fed to the secondary transfer portion T2 by moving the intermediary transfer belt 7.

On the other hand, the recording material S supplied from the cassette 42 is fed toward the secondary transfer portion T2 by the recording material feeding portion 43. That is, sheets of the recording material S are fed one by one from the cassette 42 by a pick-up roller 10, and then are fed to the secondary transfer portion T2 after being timed to the toner image on the intermediary transfer belt 7 by a registration roller 9. Then, at the secondary transfer portion T2, by applying a secondary transfer bias to the secondary transfer roller 8, the toner image on the intermediary transfer belt 7 is secondary-transferred onto the recording material S.

Thereafter, the recording material S on which the toner image is transferred is fed to the fixing device 45 in which the toners are melted and color-mixed under application of heat and pressure, so that the toner image is fixed as a print image on the recording material S. The recording material S on which the image is fixed is discharged onto the discharge tray 13 by the discharging roller 18 provided downstream of the fixing device 45. In the case where the double-side printing is effected, the recording material S after the fixing is turned upside down by a reverse feeding roller 17 and then is supplied again to the secondary transfer portion T2. Then, the recording material S passes through the fixing device 45 and then is discharged onto the discharge tray 13 by the discharging roller 18. Incidentally, in the image forming apparatus 1 in this embodiment, the discharge tray 13 is disposed between the image forming portion 40 and the scanner 41. The image forming apparatus 1 has a constitution in which the recording material S is discharged.

[Air Suction and Exhaust Device]

Next, the air suction and exhaust device 100 provided in the above-described image forming apparatus 1 will be described with reference to FIGS. 3 and 4. Incidentally, FIG. 4 is a schematic sectional view, corresponding to a schematic view as seen from a left side of the image forming apparatus 1 shown in FIG. 3, of the image forming apparatus 1 from which a part of an inside structure thereof is omitted and from which the part of the inside structure ranging from a fan 23 to a speaker 26 is cut away along an air flow guiding portion 24 and a sound transmitting portion 27. The air suction and exhaust device 100 includes a casing 200, the air flow guiding portion 24, the fan 23 as an air flow generating means, the speaker 26 as a sound generating means (sound source), the controller 51 as a control means, and the sound transmitting portion 27. The casing 200 is also a casing of the image forming apparatus 1, and inside the casing 200, the image forming portion 40, the recording material feeding portion 43 and the like are disposed. Such a casing 200 is constituted by a plurality of covers 20*a* to 20*f* and constitutes an outer casing of the image forming apparatus 1.

Here, the cover 20*a* is a cover at a front surface (in the front side of FIG. 3 and in the right side of FIG. 4) of the image forming apparatus 1. The cover 20*b* is an upper surface cover and also functions as the discharge tray 13. Further, the cover 20*c* is a portion for connecting the image forming portion 40 and the scanner 41, and is, described later, a cover for covering devices disposed in the rear side of the image forming apparatus 1. By this cover 20*c*, the cover 20*b* also functioning as the discharge tray 13 and a lower surface of the scanner 41, a discharge space where the recording material is to be discharged is defined and formed. Further, the cover 20*d* is a cover at a rear surface (in the rear side of FIG. 3 and in the left side of FIG. 4) of the image forming apparatus 1 and forms a space, between the covers 20*c* and 20*d*, where the above-described devices are disposed. The covers 20*e* and 20*f* are covers at side surfaces (in the left and right sides of FIG. 3 and in the front side and the rear side of FIG. 4) of the image forming apparatus 1, and are disposed in the left and right sides, respectively, of FIG. 3. Incidentally, the covers constituting the outer casing include, e.g., a cover for covering a bottom (surface) of the image forming apparatus 1 and a cover constituting an outer layer of the scanner 41.

Of these covers 20*a* to 20*f*, the cover in a side where the user operates the image forming apparatus 1 is provided with a suction port 22 for sucking the air into the casing 200. In this embodiment, the suction port 22 is formed at a position closer to one side, (the right side of FIG. 3) of the front surface (front side) cover 20*a* of the image forming apparatus 1, where the operating portion 46 is disposed. Incidentally, the position where the suction port 22 is formed may also be a position other than the position closer to the cover 20*a* if the position is in the side where the user operates the image forming apparatus 1. For example, the suction port 22 may also be formed at a position in the front side (e.g., at either one of front side half portions in FIG. 3 and the right half portion of FIG. 4) of either one of the covers 20*e* and 20*f* in the side-surface sides of the casing 200.

In this embodiment, the surface in the side where the operating portion 46 is disposed is the front surface of a main assembly of the image forming apparatus 1, and the surface in the side opposite from the side where the operating portion 46 is disposed is the rear surface of the main assembly of the image forming apparatus 1.

On the other hand, of the covers 20*a* to 20*f*, the cover other than the front surface cover 20*a* is provided with an exhaust port 25 for exhausting the air present inside the casing 200. In this embodiment, of the covers 20*e* and 20*f* at the side surfaces of the casing 200, the cover 20*e* in another side (the left side of FIG. 3 and the front side of FIG. 4) remote from the suction port 22 formed in one side of the cover 20*a* is provided with the exhaust port 25. The reason why the exhaust port 25 is formed at a position remote from the suction port 22 is that the air sucked through the suction port 22 is caused to be discharged through the exhaust port 25 after the air cools a predetermined portion inside the casing 200. In other words, it is because when the positions of the suction port 22 and the exhaust port 25 are close to each other, the air sucked through the suction port 22 is discharged soon through the exhaust port 25, so that cooling or the like of the predetermined portion in the casing 200 cannot be sufficiently performed. Further, the reason why the exhaust port 25 is not formed in the front surface cover 20*a* is that the air discharged through the exhaust port 25 is caused to blow less against the user who operates the image forming apparatus 1. For this reason, the exhaust port 25 may also be formed at a position which is remote from the suction port 22 and in a cover (e.g., the rear surface cover 20*d*) other than the front surface cover 20*a*. Incidentally, each of the suction port 22 and the exhaust port 25 is provided with a louver.

The air flow guiding portion 24 is a portion for guiding the air from the suction port 22 to the exhaust port 25 inside the casing 200, and guides the air along a path (air flow path) indicated by arrows of solid lines in FIGS. 3 and 4. Such an air flow guiding portion 24 is constituted by a part of the covers 20*a* to 20*f* constituting the casing 200 and a part of frames 19*a* to 19*c* supporting mechanisms disposed inside the casing 200. Here, the mechanisms disposed inside the casing 200 are the above-described image forming portion 40 and recording material feeding portion 43 and the like, and these mechanisms are supported by the plurality of frames. In this embodiment, the frames 19*a* to 19*c* are illustrated but another frame may also be provided.

Here, the frame 19*a* is disposed, substantially parallel with the front surface casing 20*a*, at a position opposing the front surface cover 20*a*, and the frame 19*c* is disposed, substantially parallel with the rear surface cover 20*d*, at a position opposing the rear surface cover 20*d*. Further, the frame 19*c* is extended to a position opposing the cover 20*c* for covering the device (the facsimile machine 61 or the like described later) disposed in the rear side of the image forming apparatus 1. Further, the frame 19*b* is disposed at a position opposing the cover 20*b* also functioning as the discharge tray 13. This frame 19*b* includes a bent portion 19*b*1 obtained by bending a front side end portion thereof in a (downward) direction spaced from the cover 20*b*, and includes a flat portion 19*b*2 which is positioned in the rear side than the bent portion 19*b*1 and which is substantially parallel to the cover 20*b*. The bent portion 19*b*1 also has the function of disposing the fan 23 (described later) and guiding the air, sucked through the suction port 22, to between the cover 20*b* and the flat portion 19*b*2.

Further, the frame 19*a* is disposed under a halfway portion of the bent portion 19*b*1 of the frame 19*c*, and the frame 19*c* is disposed in the rear side than a rear side end of the flat portion 19*b*2. Further, between these frames 19*a*, 19*b* and 19*c*, the image forming portion 40, the recording material feeding portion 43 and the like are disposed and supported by the frames 19*a*, 19*b* and 19*c*. Incidentally, the frame 19*b* also functions as a guiding plate for guiding mounting and demounting of the toner containers 12. Further, the frame 19*a* also supports the fan 23, the toner containers 12 and the like. The frame 19*c* also supports the facsimile machine 61 and the controller 51 and the like which are described later.

In the case of this embodiment, the air flow guiding portion 24 is constituted by the front surface cover 20*a*, the cover 20*b* also functioning as the discharge tray 13, the frame 19*a* and the frame 19*b*. Further, the air sucked through the suction port 22 passes through a space defined by the front surface cover 20*a*, the frame 19*a* and the bent portion 19*b*2 of the frame 19*b* and then passes through a space between the cover 20*b* also functioning as the discharge tray 13 and the frame 19*b*, thus being discharged through the exhaust port 25. Incidentally, the air flow guiding portion 24 may also be constituted so as to include another cover and another frame. That is, the air flow guiding portion 24 may only be required to be constituted so as to include the space defined by the cover 20*a*, the frame 19*a* and the bent portion 19*b*1 of the frame 19*b* and the space between the cover 20*b* and the frame 19*b*.

The fan 23 generates the flow of the air in the air flow guiding portion 24. In this embodiment, the fan 23 is disposed in the neighborhood of the suction port in a downstream side of an air flowing direction. Specifically, the fan 23 is disposed between the suction port 22 and the bent portion 19*b*1 of the frame 19*b*. Such a fan 23 may only be required to be disposed at any portion of the air flow guiding portion 24, and may also be provided in the neighborhood of, e.g., the exhaust port 25. This fan 23 is driven, so that the air is sucked in through the suction port 22 and then passes through the air flow guiding portion 24 to be discharged through the exhaust port 25.

The speaker 26 is disposed at a position remote from the side where the devices in the casing 200 are to be operated, and generates a sound. In this embodiment, the speaker 26 is disposed in the rear side opposite from the side where the devices in the casing 200 are to be operated. Specifically, the speaker 26 is disposed between the rear side cover 20*d* and the frame 19*c*. Further, the speaker 26 is disposed, in an upper side of the image forming portion 40, at a position opposing the cover 20*d* while being interposed between the cover 20*d* and the frame 19*c*. Further, in a space where the speaker 26 is disposed, the facsimile machine 61 included in the image forming apparatus 1 and the controller 51 as the control means are disposed. Incidentally, the position of the speaker 26 may also be a position other than the rear side if the position is spaced from the side where the user operates the image forming apparatus 1. For example, the speaker 26 may also be formed at a position in the rear side (e.g., at any position of a half portion in the rear side (a left-side half portion of FIG. 4) of either one of the covers 20*e* and 20*f* in both sides of the casing 200).

The facsimile machine 61 is connected with an external computer or an external facsimile machine via telephone line or a network. As a result, image data read by the scanner 41 can be connected into a signal and then can be sent to the external computer or the external facsimile machine. Further, the facsimile machine 61 can receive a signal sent from the external computer or the external facsimile machine and then can convert the signal into image data. It is possible to realize facsimile by sending and receiving these signals of the image data. Such a facsimile machine 61 is disposed in the rear side of the image forming apparatus 1 in order to be connected with the telephone line or the network.

The speaker 26 has the function of notifying the user of a processing stop, in which such signals are sent and received, by an electronic sound generated by the speaker 26. Incidentally, the speaker 26 may also generate a sound, for notifying the user of other information, such as a sound for notifying of an end of the image formation or a warning sound when jam of the recording material occurs at any portion of the recording material feeding portion 43.

The controller 51 effects general control of the image forming apparatus 1 as described later. Also this controller 51 is connected with the telephone line or the network and is capable of causing the image forming portion 40 to effect the image formation on the basis of image information sent from an external terminal such as the external computer. Also such a controller 51 is disposed in the rear side of the image forming apparatus 1 in order to be connected with the telephone line or the network. Further, the sound other than the electronic sound of the above-described facsimile machine 61 is constituted so as to be generated by the speaker 26 controlled by the controller 51.

The sound transmitting portion 27 is a portion where the sound is transmitted from the speaker 26 to the air flow guiding portion 24, and transmits the sound along a path (sound path) indicated by arrows of broken lines in FIGS. 3 and 4. Such a sound transmitting portion 27 is constituted by a part of the covers 20*a* to 20*f* constituting the casing 200 and a part of the frames 19*a* to 19*c*. In the case of this embodiment, the sound transmitting portion 27 is constituted by the cover 20*c*, the cover 20*b*, the frame 19*c* and the frame 19*b*. A spacing is formed between the cover 20*c* and the frame 19*b*, and a space between the cover 20*c* and the frame 19*b* and a space between the cover 20*b* and the frame 19*b* communicate with each other.

Further, in a sound generation side of the speaker 26, a part of the frame 19*c* and a part of the cover 20*c* are disposed in the listed order, and the frame 19*c* is provided with an opening 19*c*1 for establishing communication between the speaker 26 and the cover 20*c*. In this embodiment, the opening 19*c*1 is formed at a position, of the frame 19*c*, opposing the speaker 26. Incidentally, the opening 19*c*1 may also be formed at a position other than the position opposing the speaker 26. In summary, at any portion of the frame 19*c* disposed in the sound generation side of the speaker 26, the opening 19*c*1 may only be required to be formed so as to establish the communication between the speaker 26 and the space between the cover 20*c* and the frame 19*c*. Further, the opening 19*c*1 may also be formed at a plurality of locations in the frame 19*c* and may also be provided with a louver. Further, such an opening is not required to be particularly provided for transmitting the sound of the speaker 26, but may also be an opening, using a slit or an opening portion, which is ordinary formed in the frame 19*c*, e.g., for processing.

The sound generated from the speaker 26 passes through the opening 19*c*1 and propagates through the space between the cover 20*c* and the frame 19*c*, and then is transmitted to the space between the cover 20*b* and the frame 19*b*. Then, the sound propagates through this space (between the cover 20*b* and the frame 19*b*) to reach the suction port 22, so that the user can hear (listen to) the sound, generated from the speaker 26, through the suction port 22. Incidentally, the air flow guiding portion 24 is also connected with the exhaust port 25, and therefore the sound generated from the speaker 26 also reaches the exhaust port 25. As in this embodiment, when the exhaust port 25 is not provided at the rear surface but is provided at the side surface, the sound generated from the speaker 26 is also heard through the exhaust port 25, and therefore the user can hear this sound when the user is not at the operation side of the image forming apparatus 1.

Incidentally, even when the frame 19*c* is not provided with the opening, it is also possible to transmit the sound to the air flow guiding portion 24 by vibration of the frame 19*c* by the sound generated from the speaker 26. However, in order to transmit the sound of the speaker 26 more clearly, the frame 19c may preferably be provided with the guide and may more preferably be provided with the opening at the position opposing the speaker 26 as in this embodiment. Further, the sound transmitting portion 27 may only be required to be connected with any portion of the air flow guiding portion 24 even in a constitution other than the above constitution. That is, it is preferable that the sound transmitting portion 27 includes a communication portion 21 for establishing communication between the air flow guiding portion 24 and the space where the speaker 26 is disposed. In this embodiment, the communication portion 21 is constituted by the opening 19*c*1 formed in the frame 19*c* and the space between the frame 19*c* and the cover 20*c*. Further, the thus-constituted communication portion 21 communicates with the space, as the part of the air flow guiding portion 24, between the frame 19*b* and the cover 20*b*.

[Controller]

Figure 5:
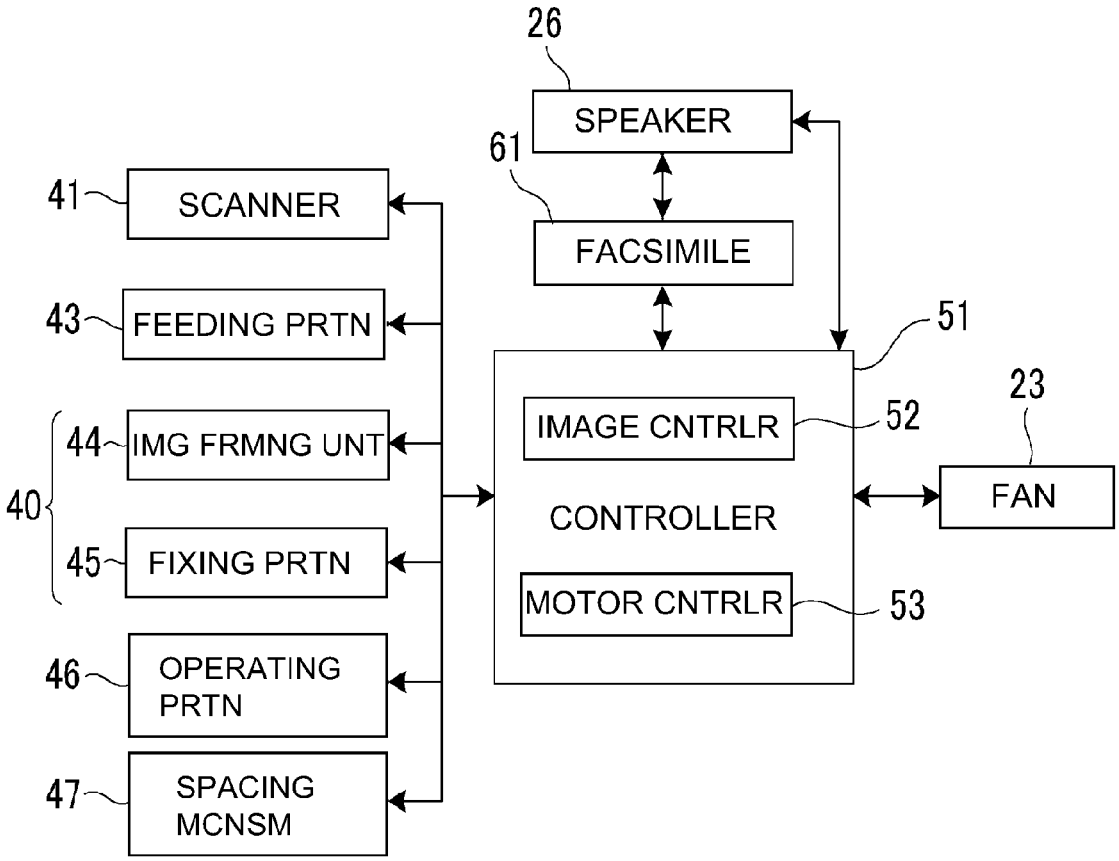
FIG. 5 is a block diagram of control of the image forming apparatus in the embodiment.
Figure 6:
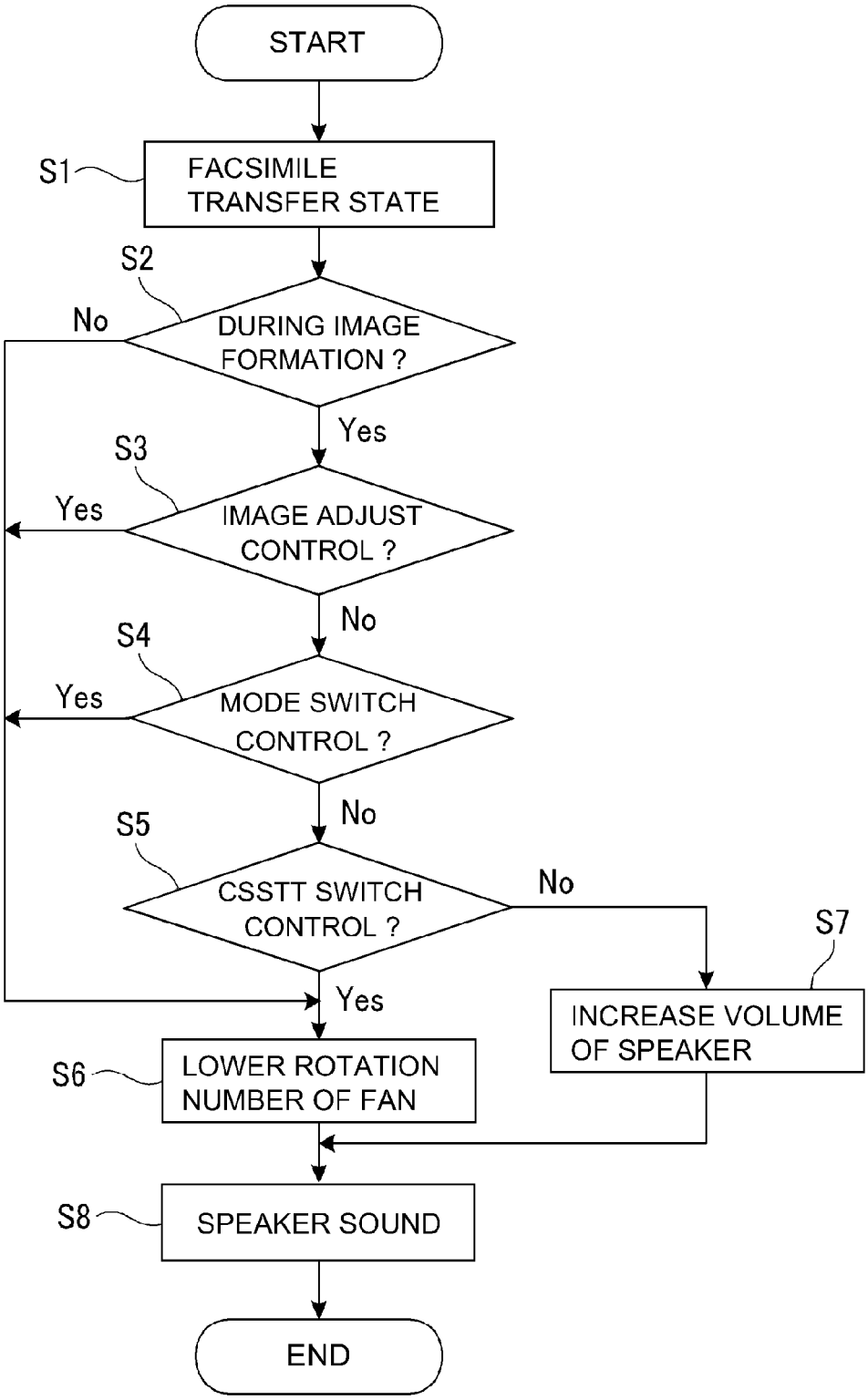
FIG. 6 is a flowchart showing an example of a flow of control of a speaker and a fan in the embodiment.

Next, details of the controller 51 as the control means will be described with reference to FIG. 5. The controller 51 is constituted by an image controller 52 and a motor controller 53, and controls an operation of the image forming apparatus 1. The image controller 52 controls image data read by the scanner 41, image data received from the facsimile machine 61, control data to be sent to the image forming portion 40 and instruction data inputted from the operating portion 46. As an operation of the image controller 52, image processing during the image formation, image adjustment executed during the image formation and selection of a mode in which a product to be outputted is formed by image formation for a full-color or a monochromatic (single) color are performed. Further, selection of the cassette 42, in which the recording material is accommodated, to be used for the image formation is made. Further, the image controller 52 is capable of controlling a volume of the speaker 26.

Further, the motor controller 53 controls operations of motors constituting the image forming portion 40, the scanner 41, the recording material feeding portion 43 and the fan 23, respectively. Specifically, the motor controller 53 controls rotation and stop of the rotation of each of a motor for performing feeding of the original in order to read the original by the scanner 41, a motor for operating respective portions of the image forming portion 40, and a motor for feeding the recording material by the recording material feeding portion 43. Further, motor controller 53 controls operations including rotation of the motor for driving the fan 23, a change in number of rotations, and stop of the rotation, i.e., controls an output of the fan 23.

Such a controller 51 is capable of controlling the output of the fan 23 depending on a condition in the following manner. First, in the case where there is a need to perform suction of the air into the casing of the image forming apparatus and exhaust of the air from the casing, the output of the fan 23 is a first output. On the other hand, in the case where the necessity of the suction and exhaust of the air into and from the casing is lowered, when the speaker 26 generates the sound, the output of the fan 23 is changed to a second output lower than the first output. Here, the second output also includes the case where the fan 23 is stopped. Further, the case where there is the need to perform the suction and exhaust of the air into and from the casing is the case where at least one of the image forming portion 40 and the recording material feeding portion 43 is driven. On the other hand, the case where the necessity of the suction and exhaust of the air into and from the casing is the case where the image forming portion 40 and the recording material feeding portion 43 are stopped or the case where only the recording material feeding portion 43 is stopped.

Further, the controller 51 is capable of controlling the volume of the speaker 26 depending on a condition in the following manner. First, in the case where the output of the fan 23 is the second output, the volume of the speaker 26 is a first volume. On the other hand, in the case where the output of the fan 23 when the speaker 26 generates the sound is the first output larger than the second output, the volume of the speaker 26 is changed to a second volume larger than the first volume.

For example, when the sound is dissipated into the outside of the image forming apparatus 1 by the speaker 26, the controller 51 lowers the rotation number of the fan 23 or stops the rotation of the fan 23 (i.e., changes the output of the fan 23 to the second output). As a result, a motor driving noise of the fan 23 can be reduced and a wind noise generated in the air flow guiding portion 24 by the fan 23 can be decreased. For this reason, when the sound dissipated by the speaker 26 propagates through the air flow guiding portion 24, a degree of interference with the wind noise is reduced, so that it becomes possible to make the sound dissipated through the suction port 22 clearer.

Next, one of specific examples of the control of the operations of the fan 23 and the speaker 26 as described above will be described with reference to FIG. 6. In this example, an operation from transfer, to a signal sending and receiving (transfer) state (S1), of a state of the facsimile machine 61 mounted in the image forming apparatus 1 to generation of the sound by the speaker 26 will be described.

First, the controller 51 discriminates whether or not the image forming apparatus 1 is in a state during image formation (S2). Then, in the case where the image forming apparatus 1 does not carry out the image formation (No of S2), the image forming portion 40 and the recording material feeding portion 43 are stopped, and therefore temperature rise is not readily generated in the casing 200. Accordingly, in this case, it can be said that the necessity of the suction and exhaust of the air into and from the casing is lowered. For this reason, the controller 51 lowers the rotation number of the fan 23 (i.e., changes the output to the second output) (S6), and then generates the sound (S8). At this time, the volume of the speaker 26 is the (ordinary) first volume.

On the other hand, in the case where the image forming apparatus 1 carries out the image formation (Yes of S2), e.g., the scanner 41 reads the original and then the image forming portion 40 effects the image formation, and the recording material feeding portion 43 feeds the recording material, and therefore the temperature in the casing 200 is liable to rise. Accordingly, in such a case, in order to suppress the temperature rise in the casing 200, the rotation number of the fan 23 cannot be lowered. For this reason, the controller 51 rotates the fan 23 at the (ordinary) first output, so that cooling power by the fan 23 is enhanced.

Next, the controller 51 discriminates whether or not the image forming apparatus 1 is in a state during image adjustment control (S3). In ordinary cases, in the image forming apparatus 1, when the image formation is continuously effected, in order to stably form the image, the image adjustment control is periodically carried out even during execution of an image forming job. In this image adjustment control, in order to temporarily stop the image formation, when the image forming apparatus 1 is in the state during the image adjustment control (Yes of S3), the operations of the image forming portion 40 and the recording material feeding portion 43 are stopped. For this reason, the controller 51 lowers, during the temporary stop of these operations causing the temperature rise in the casing 200, the rotation number of the fan 23 (i.e., changes the output to the second output) (S6), and then generates the sound of the speaker 26 (S8). Also in this case, the volume of the speaker 26 is the (ordinary) first volume. On the other hand, when the image forming apparatus 1 is not in the state during the image adjustment control (No of S3), the image formation is carried out, and therefore the controller 51 rotates the fan 23 at the (ordinary) first output.

Next, the controller 51 discriminates whether or not the image forming apparatus 1 is in a state during mode switching control (S4). That is, depending on the image data required when the image formation is continuously carried out, the operation in the monochromatic mode and the full-color mode are switched to each other in some cases. For example, depending on color information of the image data read by the scanner 41 or sent to the controller 51, the controller 51 requires the image forming portion 40 to change the operation between the full-color mode and the monochromatic mode.

When the operation change from the full-color mode to the monochromatic mode is required, the controller 51 controls the contact and separation mechanism (spacing mechanism) 47 to space, from the photosensitive drums 6, the primary transfer rollers 5 for the colors (Y, M, C) and the intermediary transfer belt 7 to which these primary transfer rollers 5 for the colors are contacted. Then, the image formation is effected by only the photosensitive drum 6 for K, so that the black toner image formed on the photosensitive drum 6 for K is transferred onto the intermediary transfer belt 7 by the primary transfer roller for K and then is transferred onto the recording material at the secondary transfer portion T2, thus carrying out the monochromatic image formation.

On the other hand, when the operation change from the monochromatic mode to the full-color mode is required, the controller 51 controls the contact and separation mechanism 47 to bring the primary transfer rollers 5 for the colors and the intermediary transfer belt 7, to which the primary transfer rollers 5 for the colors are contacted, into contact with the photosensitive drums 6. Then, the image formation is effected by all the photosensitive drums 6, so that the toner images formed on the respective photosensitive drums 6 are successively transferred onto the intermediary transfer belt 7 and then are transferred onto the recording material, thus carrying out the full-color image formation.

In this way, in the mode switching control in which the monochromatic mode and the full-color mode are switched to each other, as described above, by operating the contact and separation mechanism 47, there is a need to effect the contact and spacing between the intermediary transfer belt 7 and the photosensitive drums 6. Accordingly, similarly as in the image adjustment control, in order to temporarily stop the image formation, when the image forming apparatus 1 is in the state during the mode switching control (Yes of S4), the operations of the image forming portion 40 and the recording material feeding portion 43 are stopped. For this reason, the controller 51 lowers, during the temporary stop of these operations causing the temperature rise in the casing 200, the rotation number of the fan 23 (i.e., changes the output to the second output) (S6), and then generates the sound of the speaker 26 (S8). Also in this case, the volume of the speaker 26 is the (ordinary) first volume. On the other hand, when the image forming apparatus 1 is not in the state during the mode switching control (No of S4), the image formation is carried out, and therefore the controller 51 rotates the fan 23 at the (ordinary) first output.

Next, the controller 51 discriminates whether or not the image forming apparatus 1 is in a state during cassette switching control (S5). For example, in the case where the recording material is continuously supplied from the cassette 42 when the image formation is continued, when the recording material stacked in the cassette 42 is used up, the cassette switching control for switching the cassette 42 to another cassette 42 is carried out. Incidentally, as the cassette switching control, there is also control in which recording materials different in size are accommodated in a plurality of cassettes 42 and then the cassette 42 is changed, depending on a size of an image to be formed, to another cassette 42 in which a small-sized or large-sized recording material is accommodated.

In such control in which the switching of the cassette 42 is carried out, the recording material feeding operation cannot be performed, and therefore at least the operation of the recording material feeding portion 43 is stopped. For this reason, when the image forming apparatus 1 is in the state during the cassette switching control (Yes of S5), the controller 51 lowers, during the temporary stop of the operation causing the temperature rise in the casing 200, the rotation number of the fan 23 (i.e., changes the output to the second output) (S6). Incidentally, during the execution of the cassette switching control, the operation of the image forming unit 44 of the image forming portion 40 may also be performed. When the image forming unit 44 is operated, the operation causes the temperature rise in the casing 200, but this temperature rise can be suppressed correspondingly to the stop of the operation of the recording material feeding portion 43. Accordingly, in this embodiment, also in the case that only the operation of the recording material feeding portion 43 is stopped, the rotation number of the fan 23 is lowered. Further, the sound of the speaker 26 is generated. Also in this case, the volume of the speaker 26 is the (ordinary) first volume. On the other hand, when the image forming apparatus 1 is not in the state during the cassette switching control (No of S5), the recording material feeding is carried out, and therefore the controller 51 rotates the fan 23 at the (ordinary) first output.

Here, in the case where during the image formation, the above-described image adjustment control, mode switching control and cassette switching control cannot be carried out as interruption control (No of S5), the rotation number of the fan 23 cannot be lowered, and therefore the fan 23 is rotated at the (ordinary) first output. Accordingly, in this case, the controller 51 carries out control in which the volume of the speaker 26 is changed to the second volume larger than the first volume (S7), and then generates the sound of the speaker 26 (S8).

According to this embodiment described above, the sound is transmitted from the speaker 26 to the air flow guiding portion 24 by the sound transmitting portion 27, and therefore the sound can be generated (heard) through the suction port 22 disposed in the side where the image forming apparatus 1 is operated. For this reason, in this embodiment, even when the speaker 26 is disposed at a position remote from the apparatus operating side, i.e., in the rear side of the image forming apparatus 1, the sound can be readily heard. Further, the sound is transmitted through the air flow guiding portion 24 for performing the suction and exhaust of the air, and therefore such a structure can be realized at low cost. That is, in the case of this embodiment, by employing a constitution in which the sound is transmitted to the air flow guiding portion 24 via the sound transmitting portion 27, a particular constitution for transmitting the sound of the speaker 26, disposed at the position remote from the apparatus operating side, to the apparatus operating side is only the sound transmitting portion 27. For this reason, a cost for realizing such a structure can be reduced. Further, the speaker 26 can be disposed in the rear side where the facsimile machine 61 and the like are disposed, and therefore different from the case where the speaker 26 is disposed in the front side of the image forming apparatus 1, there is no need to provide wiring for connecting the facsimile machine 61 and the speaker 26, so that low cost and downsizing of the image forming apparatus 1 can be realized.

Further, in the case of this embodiment, each of the air flow guiding portion 24 and the sound transmitting portion 27 is constituted by the part of the cover constituting the casing 200 and the part of the frame supporting the image forming portion 40 or the like. For this reason, there is no need to separately provide a particular member for constituting the air flow guiding portion 24 and the sound transmitting portion 27. For example, in the case where a duct is separately provided for constituting the air flow guiding portion 24 and the sound transmitting portion 27, not only the cost is increased but also a space where the duct is disposed is required, so that the image forming apparatus 1 is upsized. On the other hand, in this embodiment, there is no need to separately provide such a duct, and therefore it is possible to not only realize a lower cost but also suppress the upsizing of the image forming apparatus 1.

From the above, according to this embodiment, it is possible to dispose the air flow guiding portion 24, for exhausting the heat from the inside of the casing 200, while saving the space and using a small number of parts. Further, the propagation of the sound, to the outside of the image forming apparatus 1, generated from the speaker 26 disposed inside the casing 200 can be carried out through the suction port 22 via the air flow guiding portion 24, and therefore the sound of the speaker 26 can be made clear.

Further, in this case, depending on an output state of the fan 23, the volume of the speaker 26 is controlled, and therefore even when the fan 23 is present in the air flow guiding portion 24, noises by the motor for the fan 23 and the air flow are reduced, so that the sound of the speaker 26 can be made clear.

Further, in the case of this embodiment, the suction port 22 is provided in the apparatus operating side, i.e., in the front side in this embodiment, and therefore, e.g., when a sheet treating device is provided to the image forming apparatus 1, the sound of the speaker 26 can be clearly transmitted to the outside of the image forming apparatus 1. That is, in the space where the discharge tray 13 of the image forming apparatus 1 is present, a stapler or the sheet treating device for performing bookbinding is disposed, or the sheet treating device is disposed at the side surface portion of the image forming apparatus 1 in some cases. In these cases, the sound of the speaker 26 disposed in the rear side of the image forming apparatus 1 is not readily heard unless the sound is transmitted through the air flow guiding portion 24. Further, also in the case where the sheet treating device disposed in such a manner covers the exhaust port 25 disposed at the side surface portion, the sound of the speaker 26 is not readily heard through the exhaust port 25. On the other hand, as in this embodiment, by providing the suction port 22 at the front surface of the image forming apparatus 1, the sound of the speaker 26 can be clearly heard through the suction port 22 even when the sheet treating device is disposed in the above-described manner.

Incidentally, in the description above, each of the sound transmitting portion 27 and the air flow guiding portion 24 is constituted by the part of the cover of the casing and the part of the frame, but at least one of these portions may also be constituted by a separately provided duct, e.g., when there is room in the image forming apparatus 1.

Further, the air suction and exhaust device in the present invention is, in addition to the above-described image forming apparatus, also applicable to another apparatus if the apparatus is provided with the speaker and carries out the suction and exhaust of the air into and from the casing. Further, the image forming apparatus according to the present invention is not limited to the above-described constitution, but may also be applicable to another constitution, which has been conventionally known.

According to the present invention, in order to transmit the sound from the sound generating means to the air flow guiding portion by the sound transmitting portion, the sound can be generated (heard) through the suction port, via the air flow guiding portion, disposed in the apparatus operating side. For this reason, even when the sound generating means is disposed at the position remote from the apparatus operating side, the sound can be easily heard. Further, the sound is transmitted through the air flow guiding portion where the suction and exhaust of the air are performed, and therefore such a structure can be realized at low cost.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 046724/2013 filed Mar. 8, 2013, which is hereby incorporated by reference herein in its entirety.

What is claimed is:

1. An image forming apparatus comprising:

a suction port, provided in a front side of a main assembly of said image forming apparatus, for sucking air;

an air flow guiding portion for guiding the air sucked through said suction port;

a sound source, provided in a rear side of the main assembly so as to oppose a space connected with said air flow guiding portion, for generating a sound used to notify an operator; and a communicating portion for establishing communication between said air flow guiding portion and a space in which said sound source is disposed.

2. An image forming apparatus according to claim 1, wherein said sound source is disposed at a side opposite from an operating portion of the main assembly.

3. An image forming apparatus according to claim 1, wherein said suction port is formed in a cover at a front surface of the main assembly.

4. An image forming apparatus according to claim 1, wherein said air flow guiding portion is constituted by a part of a cover constituting the main assembly and a part of a frame for supporting a mechanism provided in the main assembly.

5. An image forming apparatus according to claim 1, further comprising:

an air flow generating device for generating a flow of the air in said air flow guiding portion; and a controller for controlling an output of said air flow generating device, wherein said controller controls the output of said air flow generating device depending on an operation of said sound source.

6. An image forming apparatus according to claim 1, further comprising:

an air flow generating device for generating a flow of the air in said air flow guiding portion; and a controller for controlling an output of said air flow generating device, wherein said controller controls a volume of said sound source depending on an operation of said air flow generating device.

7. An image forming apparatus according to claim 6, wherein said controller controls the volume of said sound source so that the volume of said sound source is a first volume in the case where an output of said air flow generating device is a second output lower than a first output and so that the volume of said sound source is second volume greater than the first volume in the case where the output of said air flow generating device is the first output when said sound source generates the sound.

8. An image forming apparatus according to claim 1, further comprising:

a controller for controlling an image forming operation;

a rear-side plate, provided in the rear side of the main assembly, for supporting said controller; and a cover portion, provided in the rear side of the main assembly so as to be more remote from said suction port than said rear-side plate, for covering the rear surface of the main assembly, wherein said sound source is provided between said cover portion and said rear-side plate and generates the sound to notify the operator on the basis of a signal from said controller.

9. An image forming apparatus according to claim 8, wherein said rear-side plate is provided with an opening at a position opposing said sound source, and wherein said sound source and said air flow guiding portion communicate with each other via said opening.

10. An image forming apparatus according to claim 1, further comprising:

a facsimile machine for transmitting image information to an external device;

a rear-side plate, provided in the rear side of the main assembly, for supporting said facsimile machine; and a cover portion, provided in the rear side of the main assembly so as to be more remote from said suction port than said rear-side plate, for covering the rear side of the main assembly, wherein said sound source is provided between said cover portion and said rear-side plate and generates the sound to notify the operator on the basis of a signal from said facsimile machine.

11. An image forming apparatus according to claim 10, wherein said rear-side plate is provided with an opening at a position opposing said sound source, and wherein said sound source and said air flow guiding portion communicate with each other via said opening.

12. An image forming apparatus comprising:

a suction port, provided in a front side of a main assembly of said image forming apparatus, configured to suck air;

an air flow guiding portion configured to guide the air sucked through said suction port;

a rear-side plate, provided in the rear side of the main assembly, configured to support a rear surface of the main assembly;

a sound source configured to generate a sound used to notify an operator, said sound source opposing said rear-side plate in the rear side of the main assembly so as to be more remote from said suction port than said rear-side plate; and an opening, formed in said rear-side plate, through which said air flow guiding portion and said sound source communicate with each other.

13. An image forming apparatus according to claim 12, further comprising a controller, provided on said rear-side plate, configured to control an image forming operation, wherein said sound source generates the sound used to notify the operator on the basis of a signal from said controller.

14. An image forming apparatus according to claim 12, further comprising a facsimile machine, provided on said rear-side plate, configured to transfer image information to an external device, wherein said sound source generates the sound used to notify the operator on the basis of a signal from said facsimile machine.

15. An image forming apparatus according to claim 12, wherein said opening is provided at a position opposing said sound source.

16. An image forming apparatus according to claim 12, further comprising a cover portion, provided opposed to said rear-side plate in the front side of the main assembly, wherein said sound source communicates with said air flow guiding portion through a space, formed between said rear-side plate and said cover portion, and said opening.

17. An image forming apparatus according to claim 12, wherein said air flow guiding portion is constituted by a part of a cover constituting the main assembly and a part of a frame for supporting a mechanism provided in the main assembly.

18. An image forming apparatus comprising:

an image forming portion configured to form an image;

a rear-side plate, provided in a rear side of a main assembly of said image forming apparatus, configured to support said image forming portion;

a rear-side cover, provided opposed to said rear-side plate, configured to cover said rear-side plate;

a sound source configured to generate a sound used to notify an operator, said sound source being provided opposed to said rear-side cover between said rear-side plate and said rear-side cover;

a suction port configured to suction air, said suction port being provided closer to a front side of the main assembly than a center of the main assembly with respect to a front-rear direction of the main assembly;

an air flow guiding portion configured to form a flow path of the air suctioned through said suction port; and an opening formed in said rear-side plate, wherein said sound source communicates with the flow path through said opening.

19. An image forming apparatus according to claim 18, wherein said sound source has a surface disposed at a sound generating side so as to cover said opening.

20. An image forming apparatus according to claim 18, further comprising a facsimile machine, provided on said rear-side plate, configured to transfer image information to an external device, wherein said sound source generates the sound on the basis of a signal from said facsimile machine.

21. An image forming apparatus according to claim 18, further comprising a controller, provided on said rear-side plate, configured to control an image forming operation, wherein said sound source generates the sound on the basis of a signal from said controller.

22. An image forming apparatus according to claim 18, further comprising a front cover portion opposing said rear-side plate in the front side of the main assembly, wherein said sound source communicates, through said opening, with a space between said rear-side plate and said front cover portion, the space communicating with said flow path.

23. An image forming apparatus according to claim 18, further comprising a front cover portion opposing said rear-side plate in the front side of the main assembly, wherein said sound source communicates, through said opening, with a space between said rear-side plate and said front cover portion, the space communicating with said flow path.

24. An image forming apparatus comprising:

an image forming portion configured to form an image;

a rear-side plate, provided in a rear side of a main assembly of said image forming apparatus, configured to support said image forming portion;

a sound source configured to generate a sound used to notify an operator, said sound source being provided on a rear-side cover;

a suction port configured to suction air, said suction port being provided closer to a front side of the main assembly than a center of the main assembly with respect to a front-rear direction of the main assembly;

an air flow guiding portion configured to form a flow path of the air suctioned through said suction port; and an opening formed in said rear-side plate, wherein said sound source communicates with the flow path through said opening.

25. An image forming apparatus according to claim 24, wherein said sound source has a surface disposed at a sound generating side so as to cover said opening.

26. An image forming apparatus according to claim 24, further comprising a facsimile machine, provided on said rear-side plate, configured to transfer image information to an external device, wherein said sound source generates the sound on the basis of a signal from said facsimile machine.

27. An image forming apparatus according to claim 24, further comprising a controller, provided on said rear-side plate, configured to control an image forming operation, wherein said sound source generates the sound on the basis of a signal from said controller.

* * * * *